US012084267B2

(12) United States Patent
Schinasi et al.

(10) Patent No.: US 12,084,267 B2
(45) Date of Patent: Sep. 10, 2024

(54) BAG FOR THE STORAGE AND TRANSPORT OF A PULVERULENT PRODUCT AND METHOD OF FILLING THE SAME

(71) Applicant: Codefine International SA, Lausanne (CH)

(72) Inventors: Piero Schinasi, Epalinges (CH); Stéphane Lévy, Belmont-sur-Lausanne (CH)

(73) Assignee: Codefine International SA, Lausanne (CH)

( * ) Notice: Subject to any disclaimer, the term of this patent is extended or adjusted under 35 U.S.C. 154(b) by 533 days.

(21) Appl. No.: 17/604,165

(22) PCT Filed: Apr. 7, 2020

(86) PCT No.: PCT/IB2020/053315
§ 371 (c)(1),
(2) Date: Oct. 15, 2021

(87) PCT Pub. No.: WO2020/212804
PCT Pub. Date: Oct. 22, 2020

(65) Prior Publication Data

US 2022/0204257 A1 Jun. 30, 2022

(30) Foreign Application Priority Data

Apr. 17, 2019 (EP) ..... 19169721

(51) Int. Cl.
*B65D 88/54* (2006.01)
*B65B 1/28* (2006.01)

(52) U.S. Cl.
CPC ..... *B65D 88/548* (2013.01); *B65B 1/28* (2013.01)

(58) Field of Classification Search
CPC ..... B65D 88/548; B65B 1/28
See application file for complete search history.

(56) References Cited

U.S. PATENT DOCUMENTS 3,939,287 A * 2/1976 Orwig ..... B65B 55/18 426/316
4,913,321 A * 4/1990 Abboud ..... B65D 88/1612 222/105

(Continued)

FOREIGN PATENT DOCUMENTS

DE 202004013508 U1 2/2005
EP 1864918 A1 12/2007

(Continued)

OTHER PUBLICATIONS

International Search Report; European Patent Office; International Application No. PCT/IB2020/053315; Jun. 3, 2020; 3 pages.

(Continued)

*Primary Examiner* — Dariush Seif
(74) *Attorney, Agent, or Firm* — Taft Stettinius & Hollister LLP

(57) ABSTRACT

A bag for the storage and transport of a pulverulent product, such as agri-food, mineral, chemical or pharmaceutical powders and like powdery materials, the bag including a bottom part, a sidewall, and an upper part joined together to form a storage volume, wherein the upper part is provided with a filler inlet configured to allow the pulverulent product to be introduced inside the storage volume during a filling operation. The bag further includes lifting straps, and at least one integral elongated section made of an air-permeable material extending inside the storage volume and including an outlet accessible from the outside of the bag, the elongated section acting as an integrated filter member configured to allow insertion of an elongated air-extraction member of an air-extraction system inside the elongated section so as to extract air directly from inside the storage volume of the bag during the filling operation.

20 Claims, 8 Drawing Sheets

(56) References Cited

U.S. PATENT DOCUMENTS

| | | | | |
|---|---|---|---|---|
| 4,964,259 | A * | 10/1990 | Ylvisaker | B65B 9/213 53/511 |
| 5,746,347 | A * | 5/1998 | Riedemann | B65B 69/0075 222/1 |
| 6,120,817 | A * | 9/2000 | Archibald | B65D 33/01 426/106 |
| 6,126,975 | A * | 10/2000 | Archibald | B65D 33/2533 426/106 |
| 6,128,889 | A * | 10/2000 | Fuss | B31D 5/0078 53/472 |
| 8,950,346 | B2 | 2/2015 | Schinasi | |
| 10,550,502 | B2 | 2/2020 | Schinasi | |
| 10,968,037 | B2 * | 4/2021 | Schinasi | B65D 88/1687 |
| 11,787,114 | B2 * | 10/2023 | Gasso | B33Y 30/00 425/375 |
| 2005/0161451 | A1 * | 7/2005 | Maginot | B65B 69/0075 220/1.6 |
| 2013/0036711 | A1 * | 2/2013 | Scudder | B65D 90/048 220/666 |
| 2014/0103034 | A1 * | 4/2014 | Ross | B65D 77/061 220/666 |
| 2014/0205213 | A1 * | 7/2014 | Beer | B65D 75/46 53/405 |
| 2016/0084424 | A1 * | 3/2016 | Kuhn | F16L 59/065 53/427 |
| 2017/0001796 | A1 * | 1/2017 | Nelson | B65B 31/044 |
| 2017/0361562 | A1 * | 12/2017 | Schinasi | B65D 31/10 |
| 2018/0169945 | A1 * | 6/2018 | Chanclon Fernandez | B22F 3/004 |

FOREIGN PATENT DOCUMENTS

| | | | |
|---|---|---|---|
| JP | 107891 | U | 1/1995 |
| WO | 9854070 | A1 | 12/1998 |
| WO | 0118293 | A1 | 3/2001 |
| WO | 2010073219 | A2 | 7/2010 |
| WO | 2017216742 | A1 | 12/2017 |

OTHER PUBLICATIONS

Written Opinion of the International Searching Authority; European Patent Office; International Application No. PCT/IB2020/053315; Jun. 3, 2020; 5 pages.

* cited by examiner

BAG FOR THE STORAGE AND TRANSPORT OF A PULVERULENT PRODUCT AND METHOD OF FILLING THE SAME

CROSS REFERENCE TO RELATED APPLICATIONS

This application is a U.S. national stage filing of International Patent Application No. PCT/IB2020/053315 filed Apr. 7, 2020, which claims priority to European Application No. 19169721.8 filed Apr. 17, 2019, the contents of each application are hereby incorporated by reference in their entirety.

TECHNICAL FIELD

The present invention generally relates to a bag for the storage and transport of a pulverulent product, such as agri-food, mineral, chemical or pharmaceutical powders and like powdery materials.

BACKGROUND OF THE INVENTION

International (PCT) Publication No. WO 98/54070 A1, which publication is incorporated herein by reference in its entirety, discloses a bag in accordance with the preamble of claim 1. Different embodiments of the bag are disclosed in WO 98/54070 A1 and commonly include a bottom part, a sidewall and an upper part joined together to form a storage volume, the upper part being sometimes provided with a filler inlet configured to allow a pulverulent product to be introduced inside the storage volume of the bag during a filling operation. The sidewall is typically made of four sides connected in pairs along adjacent edges to form vertical ridges at four corners of the bag, the bag further comprising four lifting straps provided in an upper portion of the bag along the vertical ridges of the bag. Such bags are used for the storage and transport of a variety of goods, including but not limited to pulverulent products, and are commonly referred to in the art as "big-bags".

When it comes to filling such bags with a pulverulent product, one is commonly faced with the issue that air is trapped inside the storage volume of the bag as the pulverulent product is being introduced inside the bag. This trapping of air is typically exacerbated by the fact that the bottom part, top part and sidewall of the bag are commonly designed to be airtight or siftproof to prevent any powder stored inside the storage volume of the bag from sifting through the seams joining the various pieces of fabric making up the bag structure. This is particularly the case when it comes to handling mining or mineral extract products such as kaolin, carbonates, limestone and like fine powders, to name a few illustrative examples. Air is typically only allowed to escape through the upper portion of the bag and the bag therefore tends to behave like an air chamber trapping air in the manner of an inflatable balloon.

Trapping of air inside the storage volume of the bag becomes an issue in that this compromises the stability of the bag. Indeed, while the bag is reasonably stable in the first few centimetres, the bag quickly tends to lose stability as the powdery material accumulates inside the bag and traps air in the process, becoming much looser and less compact in the upper sections of the bag. This is illustrated, as representative example, in the photographic illustration of FIG. 1A which shows a conventional big-bag 10* in the process of being filled with a pulverulent product, the bag 10* being positioned under a filling station, with the filler inlet 60* of the bag 10* coupled to a filling pipe, and being held in a vertical configuration by means of the lifting straps 8*. The powdery material mixed with air is so loose in the upper and mid portions of the bag 10* that an operator can easily press the sidewall of the bag 10* inwardly by hand, demonstrating how unstable the bag 10 is in the upper sections thereof.

In essence, as long as air is trapped inside the bag 10*, the powdery product behaves like a quasi-liquid and the bag 10* therefore has to be maintained in a stable position during the filling operation.

The bag 10* only ends up taking a reasonably stable configuration, as shown in the photographic illustration of FIG. 1B, once the air trapped inside the bag 10* has been allowed to escape from the bag 10* and the pulverulent product has settled, which takes hours if not days depending on the type of pulverulent product. This settling process, which takes time, further leads to unused, and therefore lost storage space in the upper part **10*a** of the bag 10***.

In order to improve the filling of the bag, it is common in the art to equip the filling station used to fill the bag with an air extraction conduit that is routed inside the filling pipe to communicate with the upper portion of the bag, via the bag's filler inlet. The relevant air-extraction systems are however relatively complex and costly, with a price range in excess of 100'000 EUR.

European Patent Application No. EP 1 864 918 A1, which publication is also incorporated herein by reference in its entirety, discloses a bag for the storage and transport of a pulverulent product. The bottom part and sidewall of the bag are designed to be airtight, while the upper part of the bag is configured to be air-permeable and to curve like a dome during the filling operation. Air-permeability of the upper part of the bag is ensured by a multi-layered piece of fabric provided with air-permeable zones exhibiting perforations. While this improves the ability for the air to escape from the storage volume of the bag, this does not solve the inherent issue, namely the trapping of air inside the storage volume of the bag during the filling operation of the powdery product.

German Utility Model No. DE 20 2004 013 508 U1 discloses a flexible container for powders comprising an airtight bag that is provided in its upper part with an air-extraction socket provided with a filter, which air-extraction socket can be coupled to an air-extraction system. This solution suffers from a relatively poor ability to efficiently extract air during the filling operation.

Japanese Utility Model No. JP H07-891 U discloses a large bag for storage, in particular, of rice, which bag is provided in its upper part with a connector element allowing connecting to an air-extraction system. In one embodiment, the air-extraction system includes a suction pipe that is inserted through the connector element into the storage volume of the bag, the suction pipe thus coming in direct contact with the product stored in the bag. This solution is not suitable for use with pulverulent products as such products would inevitably be sucked by the suction pipe during extraction of the air, which is clearly not desired.

Further improvements are therefore required.

SUMMARY OF THE INVENTION

A general aim of the invention is to provide such a bag, which is more suited for the storage and transport of a pulverulent product.

A further aim of the invention is to provide such a bag that facilitates the filling operation of the pulverulent product and improves the extraction of air during the filling operation.

Yet another aim of the invention is to provide such a bag whose storage volume can be filled and exploited in a more optimal manner.

These aims are achieved thanks to the solutions defined in the claims.

In accordance with the invention, there is provided a bag for the storage and transport of a pulverulent product, such as agri-food, mineral, chemical or pharmaceutical powders and like powdery materials, as defined in claim 1, namely such a bag comprising a bottom part, a sidewall and an upper part joined together to form a storage volume, the upper part being provided with a filler inlet or opening configured to allow the pulverulent product to be introduced inside the storage volume of the bag during a filling operation. The bag further comprises lifting straps provided in an upper portion of the bag. According to the invention, the bag further comprises at least one elongated section made of an air-permeable material and extending inside the storage volume of the bag, which elongated section is an integral part of the bag and comprises an outlet accessible from the outside of the bag, the elongated section acting as an integrated filter member and being configured to allow insertion of an elongated air-extraction member of an air-extraction system, inside the elongated section, so as to extract air directly from inside the storage volume of the bag during the filling operation.

By way of preference, the elongated section is secured (in particular sewn) to the upper part of the bag and extends inside the storage volume of the bag towards the bottom part. In this context, the elongated section may in particular extend up to the bottom part of the bag.

In one embodiment, a distal end of the elongated section is secured to the bag. In another embodiment, the distal end of the elongated section is not secured to the bag and is repositionable inside the storage volume of the bag.

The elongated section advantageously exhibits a substantially cylindrical shape.

The outlet of the elongated section may advantageously be shaped as a collar section configured to be attached to an outer portion of the elongated air-extraction member.

Only one or multiple elongated sections could be provided, each designed to act as an integrated filter member.

The bag's sidewall may in particular be made of four sides connected in pairs along adjacent edges to form vertical ridges at four corners of the bag, and the lifting straps may be provided along the vertical ridges of the bag. Cylindrical bags are however also possible.

By way of preference, the bottom part and sidewall of the bag are configured to be airtight and/or siftproof. Furthermore, the upper part of the bag may also be configured to be airtight and/or siftproof. In this context, the aforementioned collar section forming the outlet of the elongated section may likewise be configured to be airtight and/or siftproof.

The bag can advantageously be made of fabric cut into several pieces, which are assembled together by means of seams, especially siftproof seams. By way of preference, the siftproof seams each include multiple threads that are sewn to form an alternation of mutually overlapping stitches arranged in a single line, as taught in particular in International (PCT) Application No. WO 2010/073219 A2 in the name of the present Applicant. In that respect, the pieces of fabric may be assembled together in accordance with the method disclosed in International (PCT) Application No. WO 2010/073219 A2 or the method disclosed in International (PCT) Application No. WO 2017/216742 A1, also in the name of the present Applicant.

Also claimed is a method of filling the aforementioned bag with a pulverulent material, comprising:

- providing an air-extraction system comprising an air-extraction unit coupled to an elongated air-extraction member having dimensions conforming to dimensions of the elongated section of the bag;
- inserting the elongated air-extraction member inside the elongated section of the bag;
- starting the filling operation by introducing the pulverulent product into the storage volume of the bag via the filler inlet or opening of the bag;
- activating the air-extraction system during the filling operation to extract air from inside the storage volume of the bag via the elongated section and the elongated air-extraction member as the pulverulent product is introduced into the storage volume of the bag;
- stopping the air-extraction system and removing the elongated air-extraction member from the elongated section of the bag after the filling operation is completed.

By way of preference, the air-extraction system comprises an air-extraction unit consisting of a portable industrial vacuum device, which is considerably more affordable than the known air-extraction systems that are typically used in connection with the filling of big-bags with pulverulent products.

Furthermore, the elongated air-extraction member may advantageously be provided with a manometer to monitor air pressure inside the elongated air-extraction member during air extraction.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in relation to various illustrative embodiments. It shall be understood that the scope of the invention encompasses all combinations and sub-combinations of the features of the invention disclosed herein.

Figure 2:
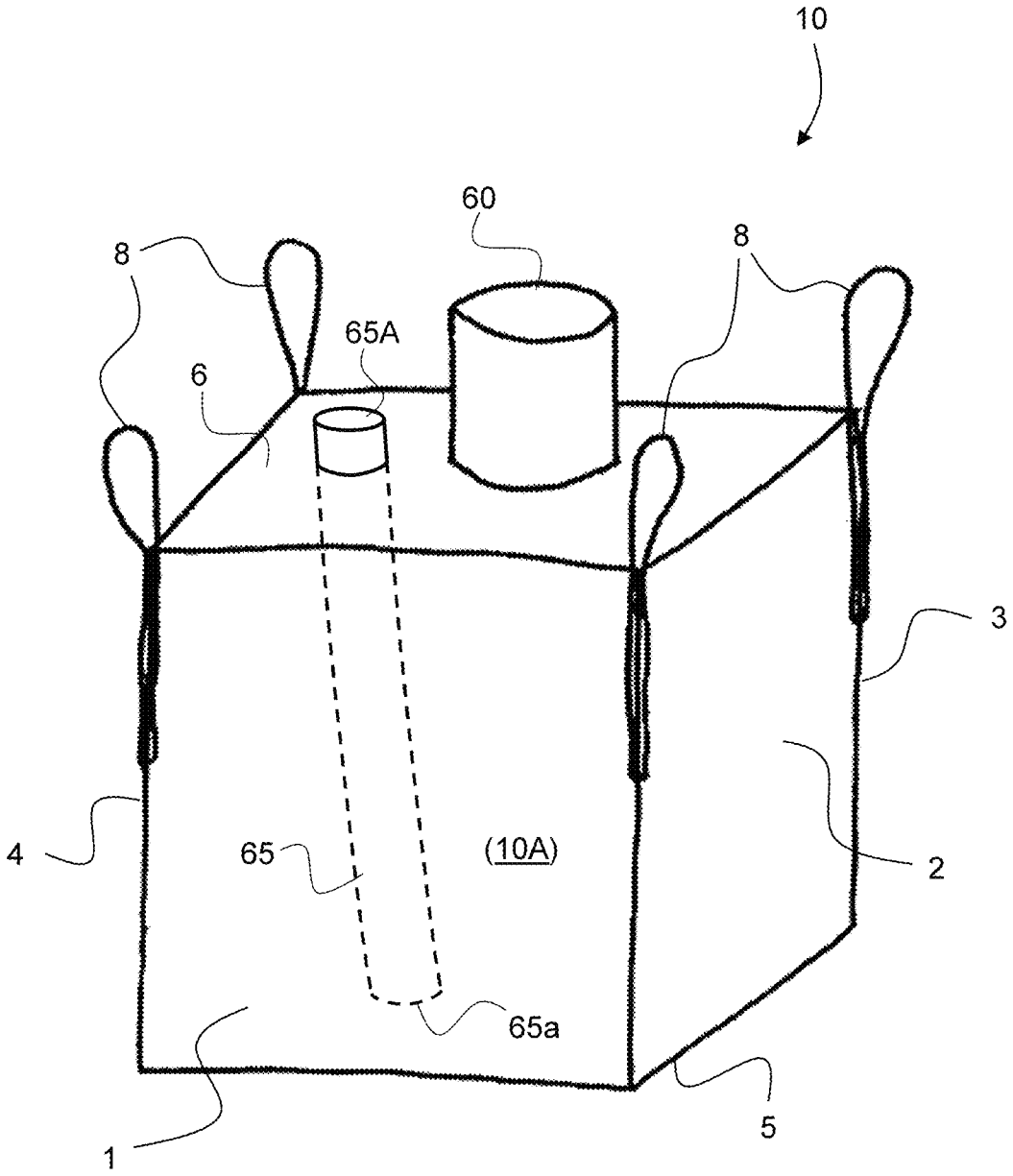
FIG. 2 is a schematic perspective view of a bag in accordance with a preferred embodiment of the invention.

FIG. 2 is a schematic perspective view of a bag, which can likewise be referred to as a big-bag, in accordance with a preferred embodiment of the invention, which bag is generally identified by reference numeral 10. FIG. 2 shows the bag 10 in a fully deployed configuration. It is to be understood that, in the fully deployed configuration, the bag 10 typically exhibits a generally cubic or cuboid shape, with possibly different width, length and height dimensions, depending on the relevant application and goods to be stored and transported. The bag dimensions (be it the width, length or height) may in particular range from approximately 60 to more than 200 centimetres, which dimensions shall however be understood as being mentioned for the purpose of illustration only. Other bag shapes could also be contemplated within the scope of the present invention.

The bag 10 is preferably manufactured from woven fabric using e.g. synthetic fibre materials (such as polypropylene or polyethylene materials), which fabric is cut into pieces that are sewn and/or welded together to form the bag structure. By way of illustration, reference can be made to International (PCT) Publications Nos. WO 01/18293 A1, WO 2010/073219 A2 and WO 2017/216742 A1 in the name of the present Applicant, which publications are incorporated herein by reference in its entirety.

Figure 1A:
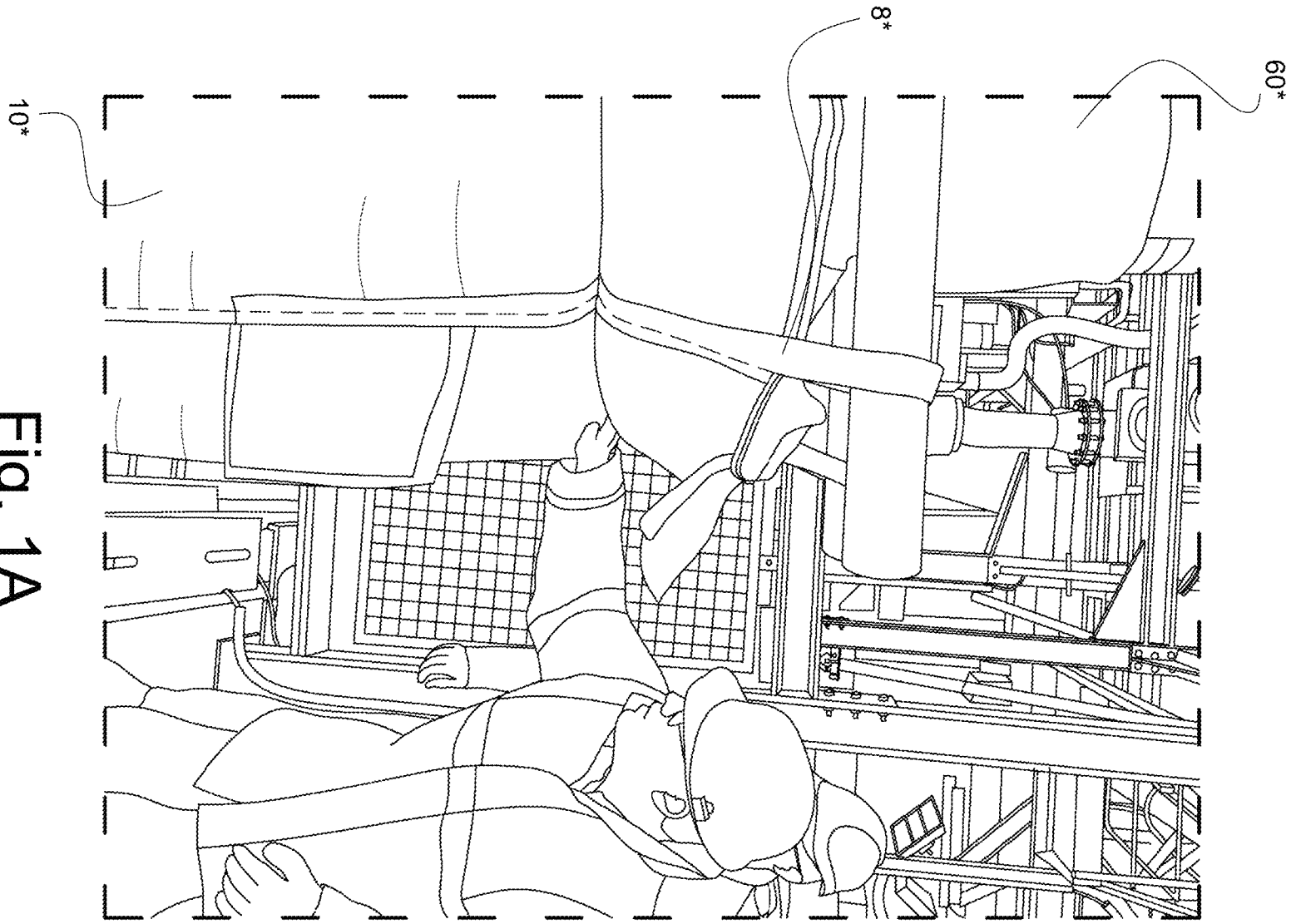
Fig. 1A (PRIOR ART)
FIG. 1A is a photographic illustration of a conventional big-bag in the process of being filled with a pulverulent product.
Figure 1B:
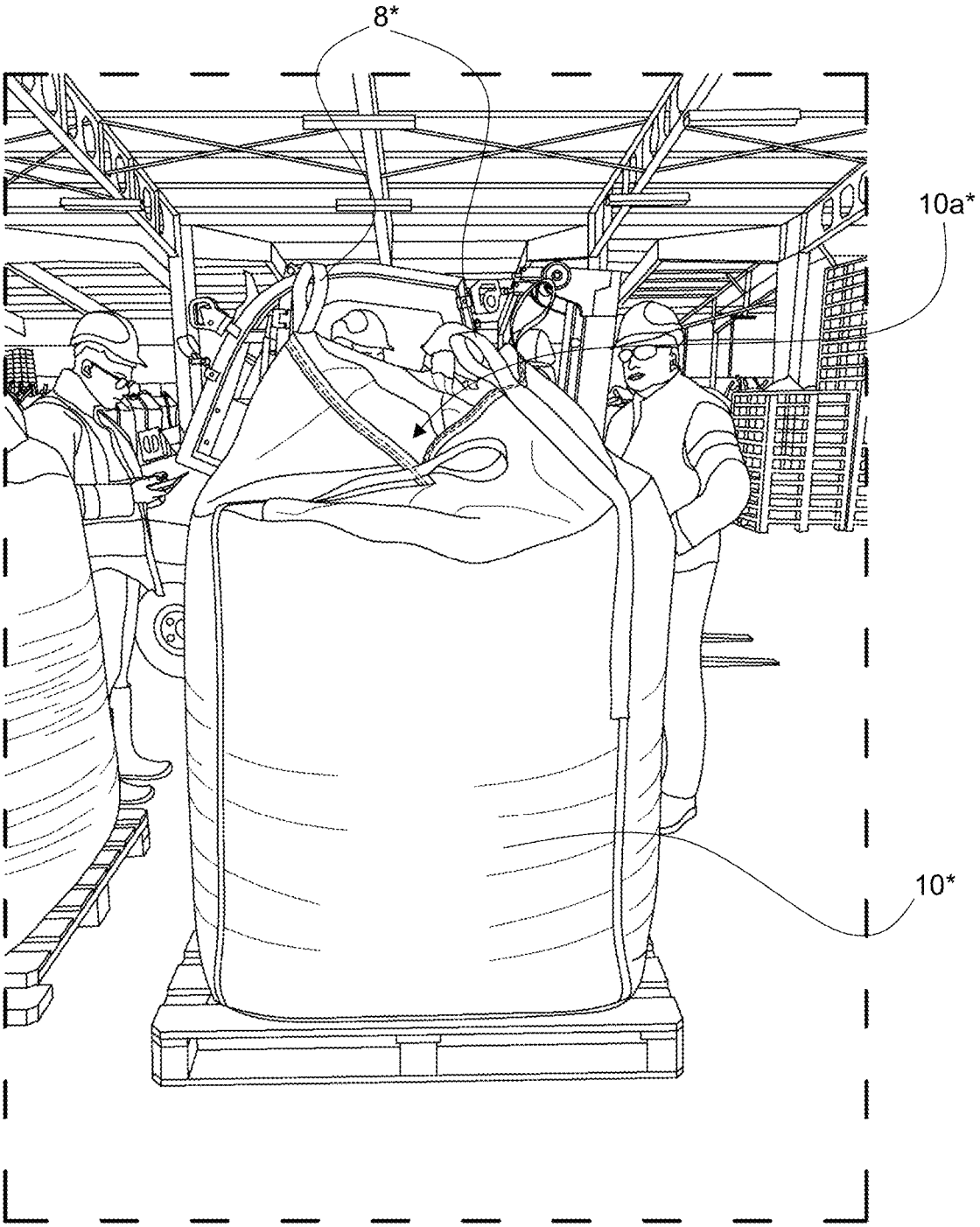
Fig. 1B (PRIOR ART)
FIG. 1B is a photographic illustration of the conventional big-bag of FIG. 1A after air trapped inside the bag has been allowed to escape and the pulverulent product has settled inside the storage volume of the big-bag.

The bag 10 generally shares a configuration similar to known bags. In particular, the bag 10 comprises at least a bottom part 5 and a sidewall here consisting of four sides 1 to 4 connected in pairs along adjacent edges to form vertical ridges at four corners of the bag 10. The bag 10 is further provided with an upper part, or lid, 6 closing the upper part thereof and provided with a filler inlet, or spout, 60 to allow introduction of a pulverulent product inside the storage volume 10A of the bag 10, like the known bag shown e.g. in FIGS. 1A and 1B. Typically, and while this is not specifically shown in FIG. 2, the bottom part 5 is further provided with an emptying outlet, or spout, to allow emptying of the bag 10. The bag 10 further comprises four lifting straps 8 provided in an upper portion of the bag 10 along the vertical ridges of the bag 10. The lifting straps 8 are here shown as individual lifting straps, but it should be understood that the lifting straps 8 may optionally be interconnected in pairs by two sleeves to form tubings or ducts on two opposite sides of the bag 10 to allow lifting of the bag 10 by means of a forklift, as taught for instance in International (PCT) Publication No. WO 98/54070 A1.

In accordance with the invention, as schematically depicted in FIG. 2, the bag 10 further comprises at least one elongated section 65 made of an air-permeable material and extending inside the storage volume 10A of the bag 10. In the illustrated example, the bag 10 comprises one such elongated section 65, but multiple elongated sections may be provided. The elongated section 65 is an integral part of the bag 10 and comprises an outlet 65A accessible from the outside of the bag 10. As this will be appreciated, the elongated section 65 is designed to act as an integrated filter member and is configured to allow insertion of a corresponding elongated air-extraction member (designated by reference numeral 220 in FIGS. 3, 3A and 4) of an air-extraction system, inside the elongated section 65, so as to extract air directly from inside the storage volume 10A of the bag 10 during the filling operation.

The elongated section 65 is here shown as being secured (in particular sewn) to the upper part 6 of the bag and extends inside the storage volume 10A of the bag 10 towards the bottom part 5. The elongated section could alternatively be secured to another part of the bag, such as to an upper portion of the sidewall 1-4. Provision of the elongated section 65 on the upper part 6 of the bag 10 is however preferred in that removal of the elongated air-extraction member 220 after the filling operation is thereby facilitated.

The elongated section 65 is preferably of substantially cylindrical shape, but other shapes could possibly be contemplated. In essence, the shape of the elongated section 65 should match the shape of the elongated air-extraction member of the air-extraction system.

Figure 2A:
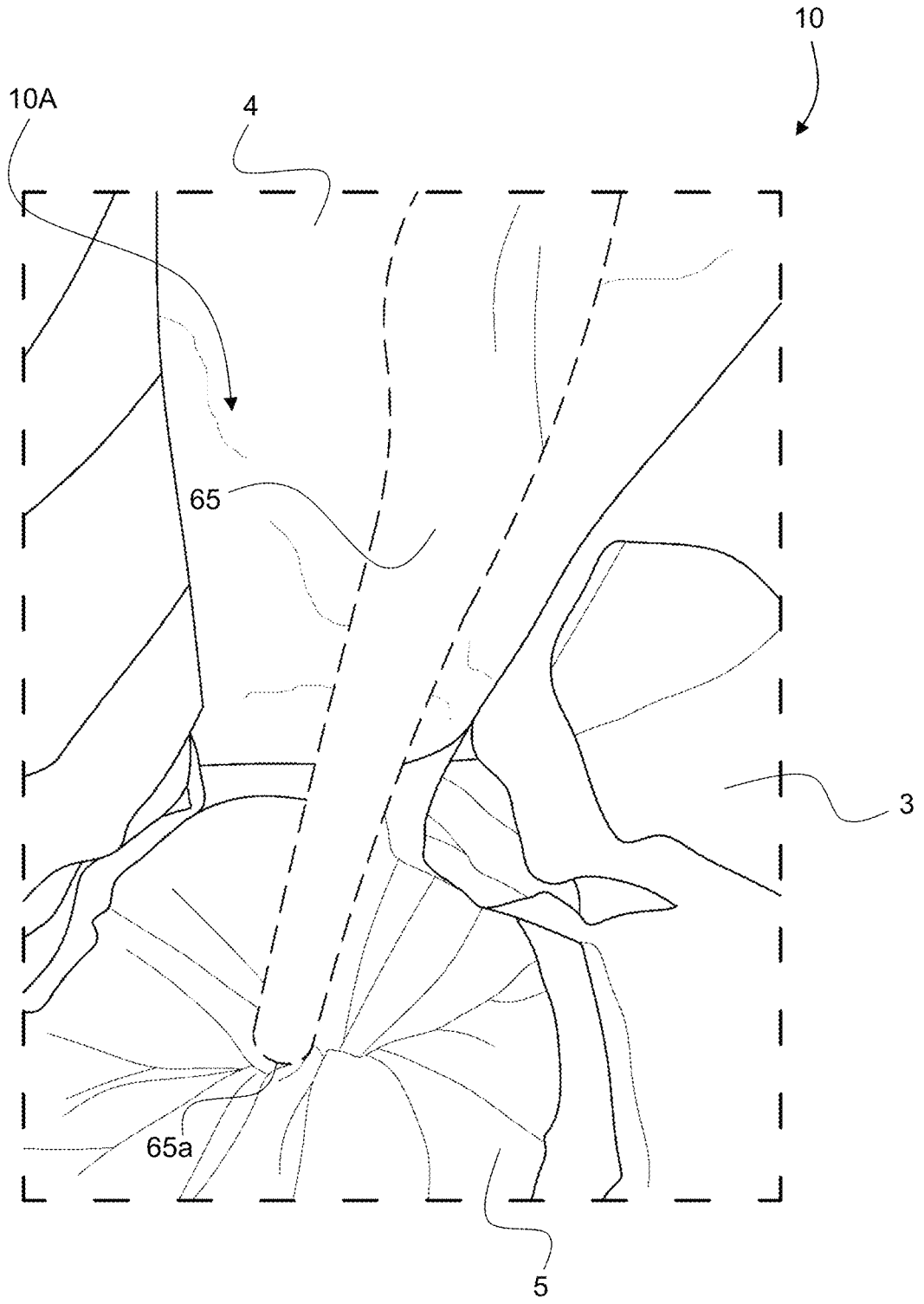
FIG. 2A is a photographic illustration of a portion of the inside of the bag of FIG. 2, revealing an elongated section extending inside the storage volume of the bag and acting as integrated filter member.

FIG. 2A is a photographic illustration of a portion of the inside of the bag of FIG. 2, revealing the elongated section 65 extending inside the storage volume 10A of the bag 10. A distal end 65*a* of the elongated section 65 could be secured to the bag 10, for instance to the bottom part 5, in which case the elongated section 65 does not need not be closed at the distal end 65*a*. In another embodiment, as shown, the distal end 65*a* of the elongated section 65 is not secured to the bag 10 and is repositionable at will inside the storage volume 10A of the bag 10. In this latter case, the distal end 65*a* of the elongated section 65 is closed to prevent the pulverulent product from being sucked together with the air extracted by the air extraction system.

The bottom part 5 and sidewall 1-4 of the bag 10 are advantageously configured to be airtight and/or siftproof, thereby preventing any contamination of the product stored in the storage volume 10A of the bag 10 as well as preventing the powdery material from sifting through the bag structure. By the same token, the upper part 6 of the bag 10 can also be configured to be airtight and/or siftproof.

Airtightness and siftproofness may be ensured by the provision of a suitable impermeable lining on the interior side of the bag 10 and/or by a suitably assembly of the pieces of fabric used to build the bag 10. In that respect, the bag 10 may in particular be made of fabric cut into several pieces that are assembled together by means of siftproof seams, in particular by sewing, in accordance with the method disclosed in International (PCT) Application No. WO 2010/073219 A2 or WO 2017/216742 A1, in the name of the present Applicant, which publications are incorporated herein by reference in their entirety.

Figure 4:
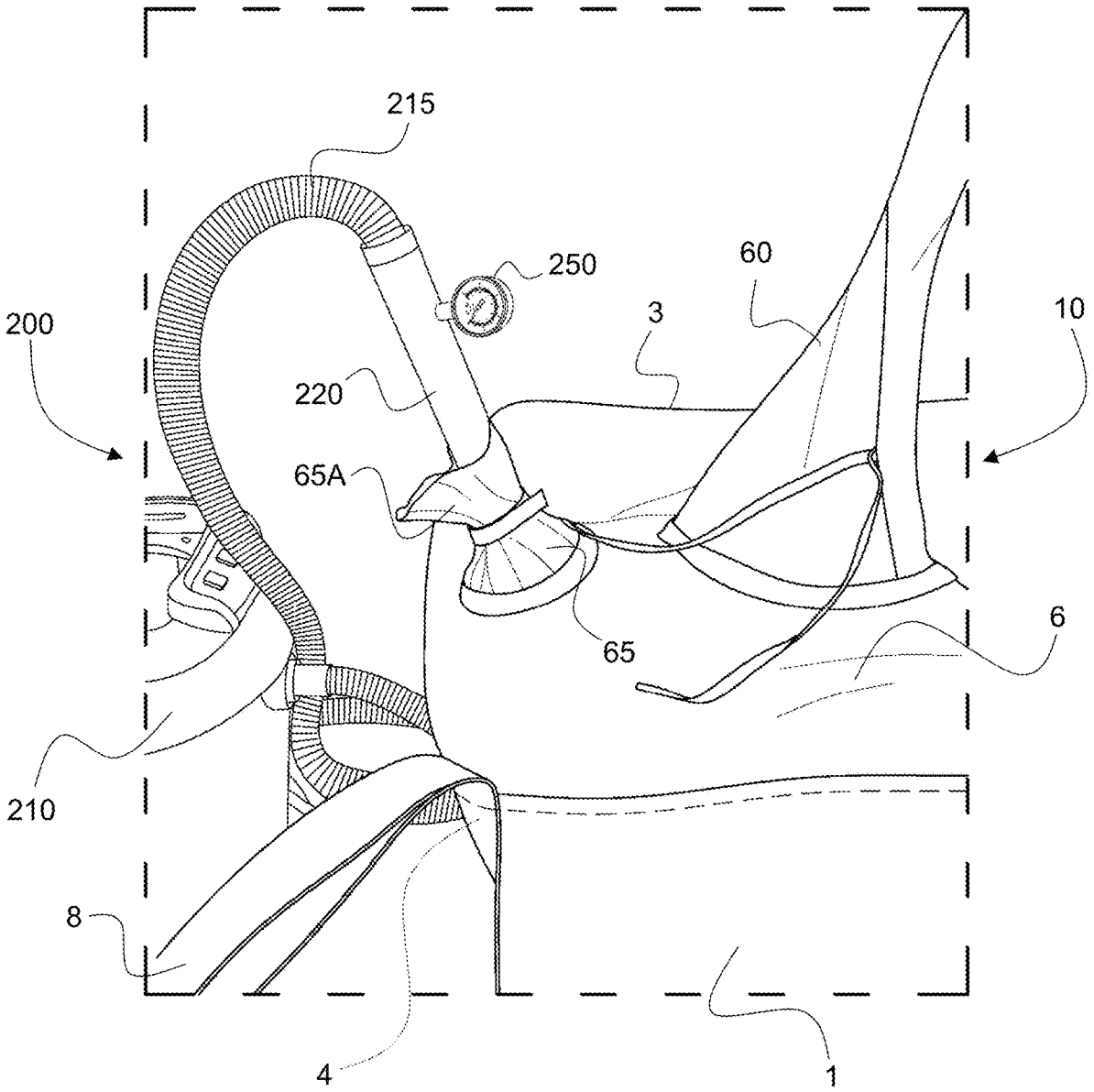
FIG. 4 is a photographic illustration showing the elongated air-extraction member of the portable industrial vacuum device of FIG. 3 inserted inside the elongated section extending inside the storage volume of the bag.
Figure 5:
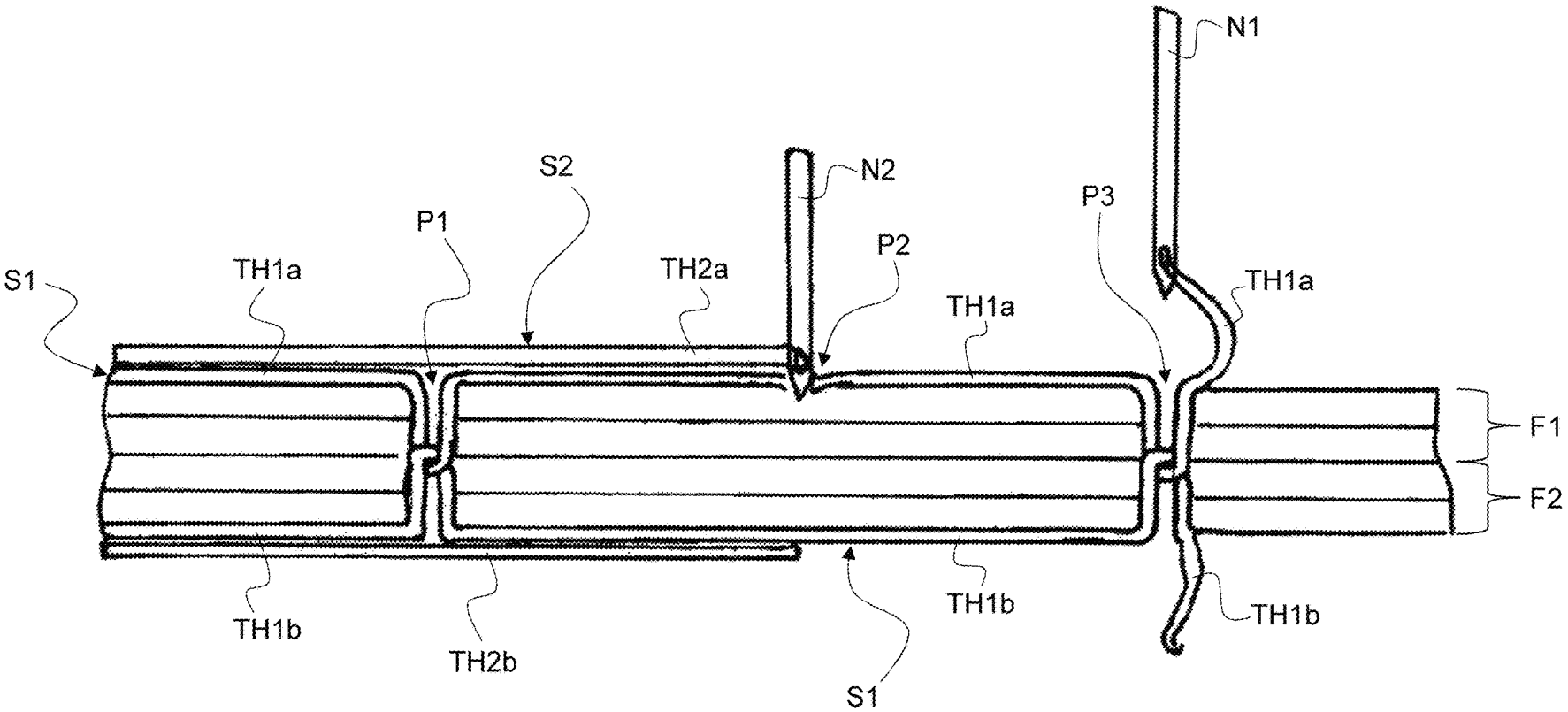
FIG. 5 is a schematic illustration of a siftproof seam made in accordance with the teaching of International (PCT) Application No. WO 2010/073219 A2.

FIG. 5 is a schematic illustration of a siftproof seam made in accordance with the teaching of International (PCT) Application No. WO 2010/073219 A2. More precisely, FIG. 5 shows the state of advance of the assembly of two pieces of fabric F1, F2 being assembled together using a sewing machine comprising an in-line arrangement of at least two needles N1, N2 that are arranged in succession one after the other along a same sewing direction (as separately shown in FIG. 4 of WO 2010/073219 A2) to form the illustrated, siftproof seam. This siftproof seam includes in essence multiple threads TH1*a*, TH1*b*, TH2*a*, TH2*b* that are sewn to form an alternation of mutually overlapping stitches S1, S2 arranged in a single line. Specifically, the first needle N1 produces a series of stitches S1 using two threads TH1*a*, TH1*b*, while the second needle N2, that is arranged in-line behind the first needle N1 with respect to the sewing direction, produces another series of stitches S2 using two further threads TH2*a*, TH2*b*. At the stage of advance pictured in FIG. 5, the first needle N1 has just finished producing a new stitch S1 after having perforated the pieces of fabric F1, F2 at perforation P3. At this moment, the second needle N2 is put into action to start a new perforation P2 through the (upper) thread TH1*a* of the stitch S1 that has just been formed by the first needle N1, namely at a position located between perforations P1, P3 previously made by the first needle N1. In this way, the perforation P2 formed by the second needle N2 is partly filled at its entry point by the thread TH1*a*. Moreover, the (upper and lower) threads TH2*a*, TH2*b* cover the stitches S1 previously formed by the first needle N1, including in the area of perforation P1 made by the first needle N1. In the example illustrated in FIG. 5, the pieces of fabric F1, F2 are double-thickness pieces of fabric. Furthermore, as a result of the sewing process, the outer piece of fabric F1 tends to slide slightly with respect to the inner piece of fabric F2, thus contributing towards obstruction of the perforations in the seam, thereby making it siftproof.

Figure 3:
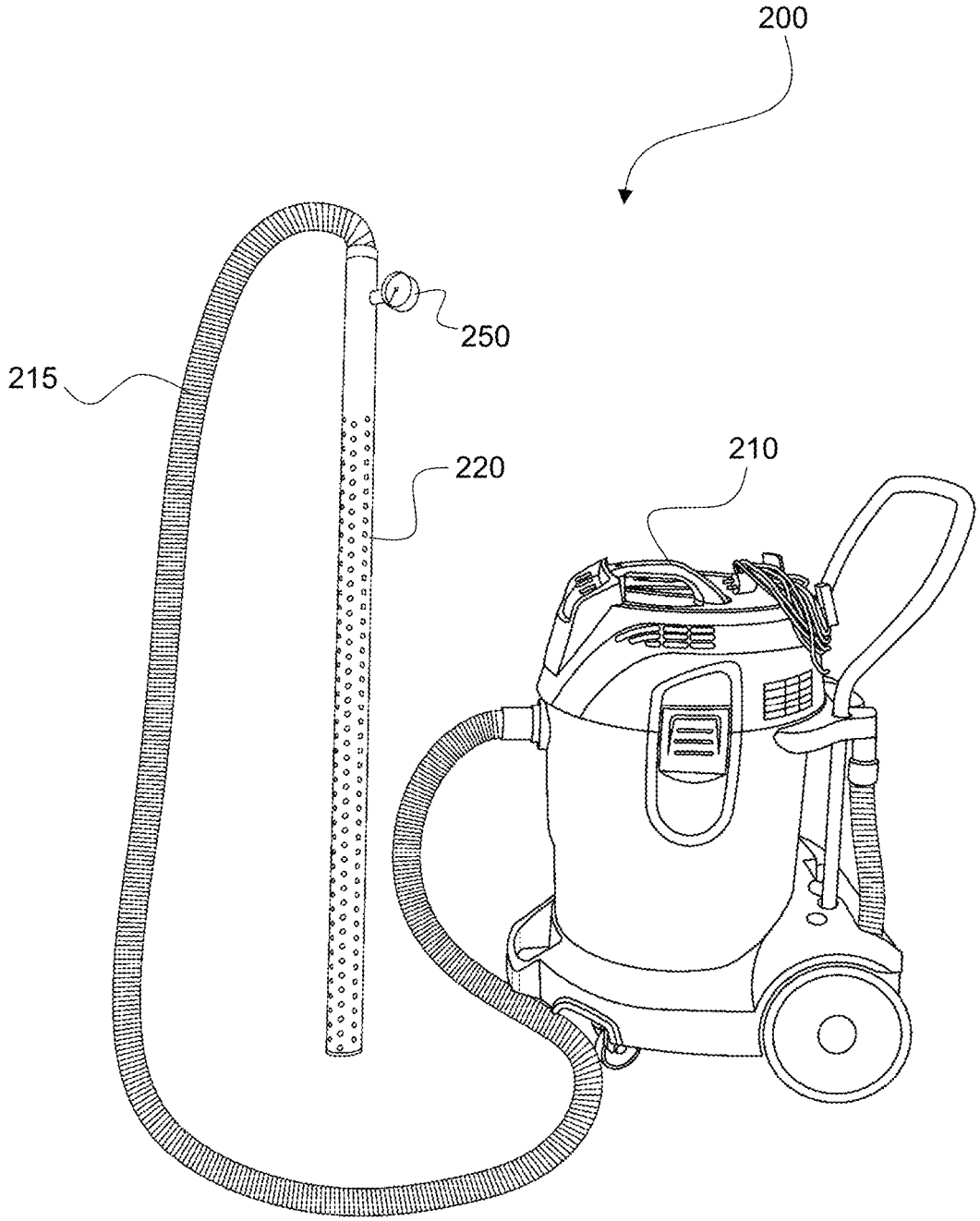
FIG. 3 is a photographic illustration of a portable industrial vacuum device used as air-extraction system in connection with the bag of FIGS. 2 and 2A.

FIG. 3 is a photographic illustration of an air-extraction system 200 used in connection with the bag of FIGS. 2 and 2A during the filling operation. This air-extraction system 200 may comprise an air-extraction unit 210 consisting of a portable industrial vacuum device, as generally available on the market from suppliers like Kärcher and the like, which air-extraction unit 210 is coupled to a custom-designed elongated air-extraction member 220 via a flexible tubing 215. This considerably reduces costs compared to the typical air-extraction systems of the prior art. Indeed, a suitable industrial vacuum device typically costs in the range of 8'000 to 10'000 EUR, one order of magnitude less than the conventional air-extraction systems used in the context of the filling of big-bags with powdery products.

Figure 3A:
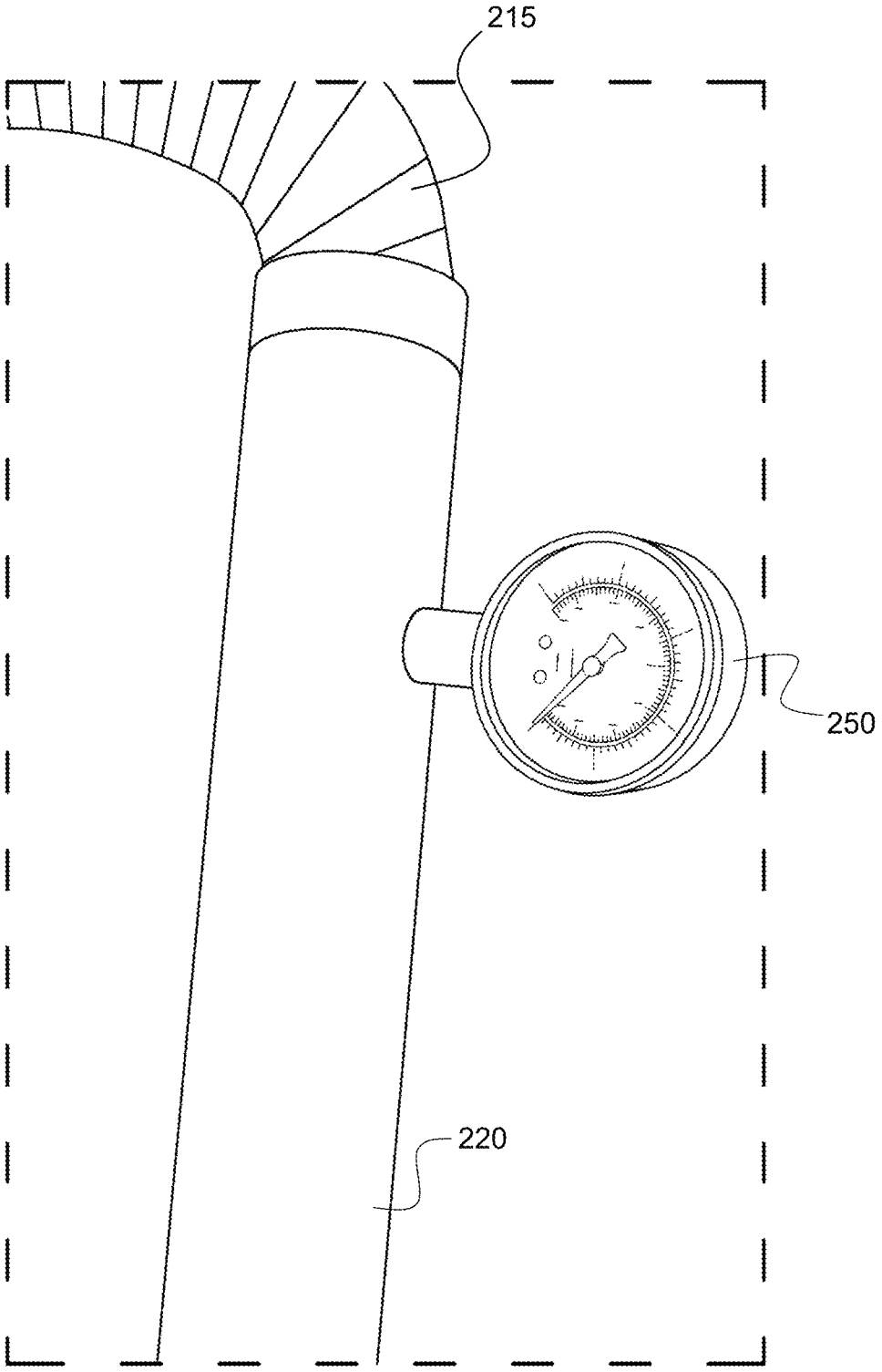
FIG. 3A is an enlarged photographic illustration of an elongated air-extraction member of the portable industrial vacuum device of FIG. 3.

As shown in FIG. 3A, the elongated air-extraction member 220 is preferably provided with a manometer 250 to monitor air pressure inside the elongated air-extraction member 220 during air extraction.

The elongated air-extraction member 220 here exhibits a substantially cylindrical shape conforming to the shape of the elongated section 65 of the bag 10. Any other shape could be contemplated as long as the elongated air-extraction member 220 can be inserted inside the elongated section 65 of the bag 10, as for instance shown in FIG. 4.

By way of preference, the outlet 65A of the elongated section 65 is designed as a collar section configured to be attached to an outer portion of the elongated air-extraction member 220, as depicted in FIG. 4. Such collar section may especially be attached by tightening a securing band around the collar section and the elongated air-extraction member 220, as shown. This collar section may likewise be configured to be airtight and/or siftproof.

Filling of the bag of the invention with a pulverulent product may be carried out as follows:

- firstly, a suitable air-extraction system, like the air extraction system 200 of FIG. 3, is provided, comprising an air-extraction unit 210 coupled to an elongated air-extraction member 220 having dimensions conforming to dimensions of the elongated section 65 of the bag 10;
- the elongated air-extraction member 220 is then inserted inside the elongated section 65 of the bag 10 (as shown in FIG. 4);
- thereafter, the filling operation can be started by introducing the pulverulent product into the storage volume 10A of the bag 10 via the filler inlet 60 of the bag 10;
- while the filling operation is underway, the air-extraction system 200 is activated in order to extract air from inside the storage volume 10A of the bag 10, via the elongated section 65 and the elongated air-extraction member 220, as the pulverulent product is being introduced into the storage volume 10A of the bag 10; and
- finally, after the filling operation is completed, the air-extraction system 200 can be stopped and the elongated air-extraction member 220 can be removed from the elongated section of the bag 10.

In effect, the air-extraction system 200 could stay active for some time after the filling operation has been completed in order to extract as much air as possible from the storage volume 10A of the bag 10.

In a variant, the air-extraction member 220 could be progressively removed as the bag is being filled with the pulverulent product, thereby allowing the pulverulent product to progressively fill the space left by the retraction of the air-extraction member 220. This being said, the volume occupied by the air-extraction member 220 is considerably smaller than the lost storage space that results from settling of the powdery product in the solutions of the prior art (see again FIG. 1B), and removal of the air-extraction member 220 will not therefore lead to any significant loss of storage space inside the storage volume 10A of the bag 10.

The bag of the present invention and related method of filling the bag with a pulverulent product considerably reduces the required time for the pulverulent product to settle inside the bag, namely from hours, or even days, to just a few minutes. Furthermore, and in contrast to the known solutions, the bag's storage volume can be exploited in a more optimal manner as air is extracted more efficiently during the filling operation, leading to a reduction or complete elimination of unused, lost storage space in the upper portion of the bag. The invention therefore allows to achieve a significant reduction of waste.

Various modifications and/or improvements may be made to the above-described embodiments without departing from the scope of the invention as defined by the appended claims. For instance, while the bag is shown as being of generally cubic form, the bag could alternatively exhibit a more elongated shape in one direction, for instance be taller or wider, or a substantially cylindrical shape, depending on the relevant application.

Furthermore, the filler inlet or opening may take any suitable shape or configuration adapted to allow introduction of a pulverulent product inside the storage volume of the bag.

LIST OF REFERENCE NUMERALS AND SIGNS USED THEREIN

10* bag (prior art of FIGS. 1A and 1B)
10*a upper, unused portion of bag 10* after settling of powdery product inside the bag 10***
8* lifting straps of bag 10*
60* filler inlet of bag 10*
10 bag (embodiment of the invention)
10A storage volume of bag 10
1 first side of bag 10 (part of sidewall)
2 second side of bag 10 (part of sidewall)
3 third side of bag 10 (part of sidewall)
4 fourth side of bag 10 (part of sidewall)
5 bottom part of bag 10
6 upper part of bag 10
8 lifting straps of bag 10
60 filler inlet or opening of bag 10 for introduction of pulverulent product
65 elongated section acting as integrated filter member
65A outlet of elongated section (collar section)
65*a* distal end of elongated section 65

200 air-extraction system
210 air-extraction unit (e.g. portable industrial vacuum device)
215 flexible tubing
220 elongated air-extraction member coupled to flexible tubing 215 and configured to be inserted inside elongated section 65 of bag 10
250 manometer coupled to elongated air-extraction member 220
F1 first piece of (e.g. double-thickness) fabric
F2 second piece of (e.g. double-thickness) fabric
N1 first needle of sewing machine
N2 second needle of sewing machine arranged in-line behind the first needle N1 with respect to the sewing direction
P1, P3 perforations made by first needle N1
P2 perforation made by second needle N2
S1 first series of stitches made by first needle N1
S2 second series of stitches made by second needle N2
TH1*a* upper thread of stitches S1
TH1*b* lower thread of stitches S1
TH2*a* upper thread of stitches S2
TH2*b* lower thread of stitches S2

The invention claimed is:

1. A bag for the storage and transport of a pulverulent product comprising a bottom part, a sidewall and an upper part joined together to form a storage volume, wherein the upper part is provided with a filler inlet or opening configured to allow the pulverulent product to be introduced inside the storage volume of the bag during a filling operation, wherein the bag further comprises lifting straps provided in an upper portion of the bag, wherein the bag further comprises at least one elongated section made of an air-permeable material and extending inside the storage volume of the bag, which elongated section is an integral part of the bag and comprises an outlet accessible from the outside of the bag, the elongated section acting as an integrated filter member and being configured to allow insertion of an elongated air-extraction member of an air-extraction system, inside the elongated section, so as to extract air directly from inside the storage volume of the bag during the filling operation.

2. The bag according to claim 1, wherein the elongated section is secured to the upper part of the bag and extends inside the storage volume of the bag towards the bottom part.

3. The bag according to claim 2, wherein the elongated section is sewn to the upper part of the bag.

4. The bag according to claim 2, wherein the elongated section extends up to the bottom part of the bag.

5. The bag according to claim 1, wherein a distal end of the elongated section is secured to the bag.

6. The bag according to claim 1, wherein a distal end of the elongated section is not secured to the bag and is repositionable inside the storage volume of the bag.

7. The bag according to claim 1, wherein the elongated section exhibits a substantially cylindrical shape.

8. The bag according to claim 1, wherein the outlet of the elongated section is shaped as a collar section configured to be attached to an outer portion of the elongated air-extraction member.

9. The bag according to claim 8, wherein the bottom part, upper part, and sidewall of the bag are configured to be airtight and/or siftproof, and wherein the collar section forming the outlet of the elongated section is likewise configured to be airtight and/or siftproof.

10. The bag according to claim 1, comprising multiple said elongated sections each designed to act as an integrated filter member.

11. The bag according to claim 1, wherein the sidewall is made of four sides connected in pairs along adjacent edges to form vertical ridges at four corners of the bag, and wherein the lifting straps are provided along the vertical ridges of the bag.

12. The bag according to claim 1, wherein at least the bottom part and sidewall of the bag are configured to be airtight and/or siftproof.

13. The bag according to claim 12, wherein the upper part of the bag is also configured to be airtight and/or siftproof.

14. The bag according to claim 1, wherein the bag is made of fabric cut into several pieces, which are assembled together by means of seams.

15. The bag according to claim 14, wherein the seams are siftproof seams.

16. The bag according to claim 15, wherein the siftproof seams each include multiple threads that are sewn to form an alternation of mutually overlapping stitches arranged in a single line.

17. A method of filling the bag of claim 1 with a pulverulent product, comprising:

providing an air-extraction system comprising an air-extraction unit coupled to an elongated air-extraction member having dimensions conforming to dimensions of the elongated section of the bag;

inserting the elongated air-extraction member inside the elongated section of the bag;

starting the filling operation by introducing the pulverulent product into the storage volume of the bag via the filler inlet or opening of the bag;

activating the air-extraction system during the filling operation to extract air from inside the storage volume of the bag via the elongated section and the elongated air-extraction member as the pulverulent product is introduced into the storage volume of the bag; and stopping the air-extraction system and removing the elongated air-extraction member from the elongated section of the bag after the filling operation is completed.

18. The method according to claim 17, wherein the air-extraction system comprises an air-extraction unit consisting of a portable industrial vacuum device.

19. The method according to claim 17, wherein the elongated air-extraction member is provided with a manometer to monitor air pressure inside the elongated air-extraction member during air extraction.

20. The method according to claim 17, wherein the pulverulent product includes agri-food, mineral, chemical or pharmaceutical powders or powdery materials.

* * * * *